US008342581B2

(12) United States Patent
Dow

(10) Patent No.: US 8,342,581 B2
(45) Date of Patent: Jan. 1, 2013

(54) VEHICLE LATCH WITH PENDULUM STOP ON RELEASE LEVER

(75) Inventor: Ian J. Dow, Royal Oak, MI (US)

(73) Assignee: Inteva Products, LLC, Troy, MI (US)

( * ) Notice: Subject to any disclaimer, the term of this patent is extended or adjusted under 35 U.S.C. 154(b) by 199 days.

(21) Appl. No.: 12/814,688

(22) Filed: Jun. 14, 2010

(65) Prior Publication Data

US 2011/0304162 A1 Dec. 15, 2011

(51) Int. Cl.
*E05C 3/02* (2006.01)
*E05C 3/04* (2006.01)
*E05C 3/16* (2006.01)

(52) U.S. Cl. ..... 292/216; 292/194; 292/219; 292/226

(58) Field of Classification Search ..... 292/194, 292/219, 216, 226, DIG. 23, DIG. 65
See application file for complete search history.

(56) References Cited

U.S. PATENT DOCUMENTS 4,451,062 A * 5/1984 Ziv ..... 280/806
4,536,021 A * 8/1985 Mochida ..... 292/201
4,906,035 A * 3/1990 Nagai et al. ..... 292/201
4,988,134 A * 1/1991 Vidwans et al. ..... 292/198
6,464,270 B1 * 10/2002 Sloan et al. ..... 292/336.3
6,565,134 B1 * 5/2003 Stuart et al. ..... 292/336.3
6,880,867 B2 * 4/2005 Schoen et al. ..... 292/216
6,966,583 B2 * 11/2005 Ji et al. ..... 292/231
6,971,688 B2 * 12/2005 Drysdale et al. ..... 292/216
7,424,814 B2 * 9/2008 Jasper ..... 70/92
2002/0163207 A1 * 11/2002 Rogers et al. ..... 292/216
2011/0304162 A1 * 12/2011 Dow ..... 292/226

* cited by examiner

*Primary Examiner* — Thomas Beach
*Assistant Examiner* — Nathan Cumar
(74) *Attorney, Agent, or Firm* — Cantor Colburn LLP

(57) ABSTRACT

A vehicle door latch assembly is provided, the vehicle door latch assembly having: a release lever pivotally secured to the latch assembly for movement between a locked position and an unlatched position; a pendulum stop pivotally secured to the release lever for movement between a blocking position and an unblocking position, wherein the release lever is prevented from moving to the locked position when the pendulum stop is in the blocking position; and a spring for biasing the pendulum stop into the unblocking position wherein the pendulum stop is configured such that movement of the release lever from the unlatched position towards the locked position will cause the pendulum stop to move from the unblocking position to the blocking position such that movement of the release lever from the unlatched position towards the locked position is limited to a predetermined position between the locked position and the unlatched position.

18 Claims, 2 Drawing Sheets

VEHICLE LATCH WITH PENDULUM STOP ON RELEASE LEVER

BACKGROUND

Exemplary embodiments of the present invention relate to vehicle latch assemblies and, more particularly to a pendulum stop for a release lever of a latch assembly.

A vehicle frequently includes displaceable panels such as doors, hood, trunk lid, hatch and the like which are affixed for hinged or sliding engagement with a host vehicle body. Cooperating systems of latches and strikers are typically provided to ensure that such panels remain secured in their fully closed position when the panel is closed.

A door latch typically includes a fork bolt that is pivoted between an unlatched position and a primary latched position when the door is closed to latch the door in the closed position. The fork bolt is typically held in the primary latched position by a detent lever that pivots between an engaged position and a disengaged position. The detent lever is spring biased into the engaged position and thus, holds the fork bolt in the primary latched position when in the engaged position and releases the fork bolt when it is moved to the disengaged position so that the door can be opened.

The fork bolt is pivoted to the primary latched position by a striker attached to, for example, an associated door jamb when the door is closed. Once in the primary latched position, the detent lever engages the fork bolt to ensure the assembly remains latched.

In order to open a vehicle door, an inner door handle is coupled to a release lever by a cable, which is also used in a push/pull configuration to lock and unlatch the latch assembly.

Accordingly, it is desirable to provide a latch assembly wherein the release lever is not inadvertently moved from an unlatched position to a locked position. More specifically, it is desirable to provide a stop for the release lever of the latch assembly.

SUMMARY OF THE INVENTION

In accordance with an exemplary embodiment of the invention, a vehicle door latch assembly is provided, the vehicle door latch assembly having: a release lever pivotally secured to the latch assembly for movement between a locked position and an unlatched position; a pendulum stop pivotally secured to the release lever for movement between a blocking position and an unblocking position, wherein the release lever is prevented from moving to the locked position when the pendulum stop is in the blocking position; and a spring for biasing the pendulum stop into the unblocking position wherein the pendulum stop is configured such that movement of the release lever from the unlatched position towards the locked position will cause the pendulum stop to move from the unblocking position to the blocking position such that movement of the release lever from the unlatched position towards the locked position is limited to a predetermined position between the locked position and the unlatched position.

In another exemplary embodiment, a method of limiting movement of a release lever of a vehicle latch assembly is provided, the method including the steps of: pivotally securing the release lever to the vehicle latch assembly for movement between an unlatched position and a locked position; pivotally securing a pendulum stop lever to the release lever for movement between a blocking position and an unblocking position, wherein the release lever is prevented from moving to the locked position when the pendulum stop is in the blocking position; biasing the pendulum stop into the unblocking position wherein the pendulum stop is configured such that movement of the release lever from the unlatched position towards the locked position will cause the pendulum stop to move from the unblocking position to the blocking position such that movement of the release lever from the unlatched position towards the locked position is limited to a predetermined position between the locked position and the unlatched position.

Additional features and advantages of the various aspects of exemplary embodiments of the present invention will become more readily apparent from the following detailed description in conjunction with the drawings wherein like reference numerals refer to corresponding parts in the several views.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF EXEMPLARY EMBODIMENTS

Exemplary embodiments of the present invention relate to a vehicle door latch assembly having a pendulum stop for limiting movement of a release lever of the latch assembly under certain conditions.

In an exemplary embodiment, the inside release lever is pulled by a cable to unlatch the latch assembly in addition to being pushed by same cable to lock the latch assembly. Thus, unlocking is achieved by a cable pull in same direction as unlatching. The assembly or release lever has a spring to return the release lever to a home position and the biasing force of the spring is sufficient to provide the required feel for the cable effort in both directions (locking and unlatching) as well as the required resistance for preventing undesired lever movement due to external forces applied to the latch assembly.

However, if the release lever is pulled to a maximum unlatching position in one direction and then released, the biasing force of the return spring could rotate the release lever through the home or neutral position and into a locked position from the unlatched position, which may not be desirable.

Figure 1:
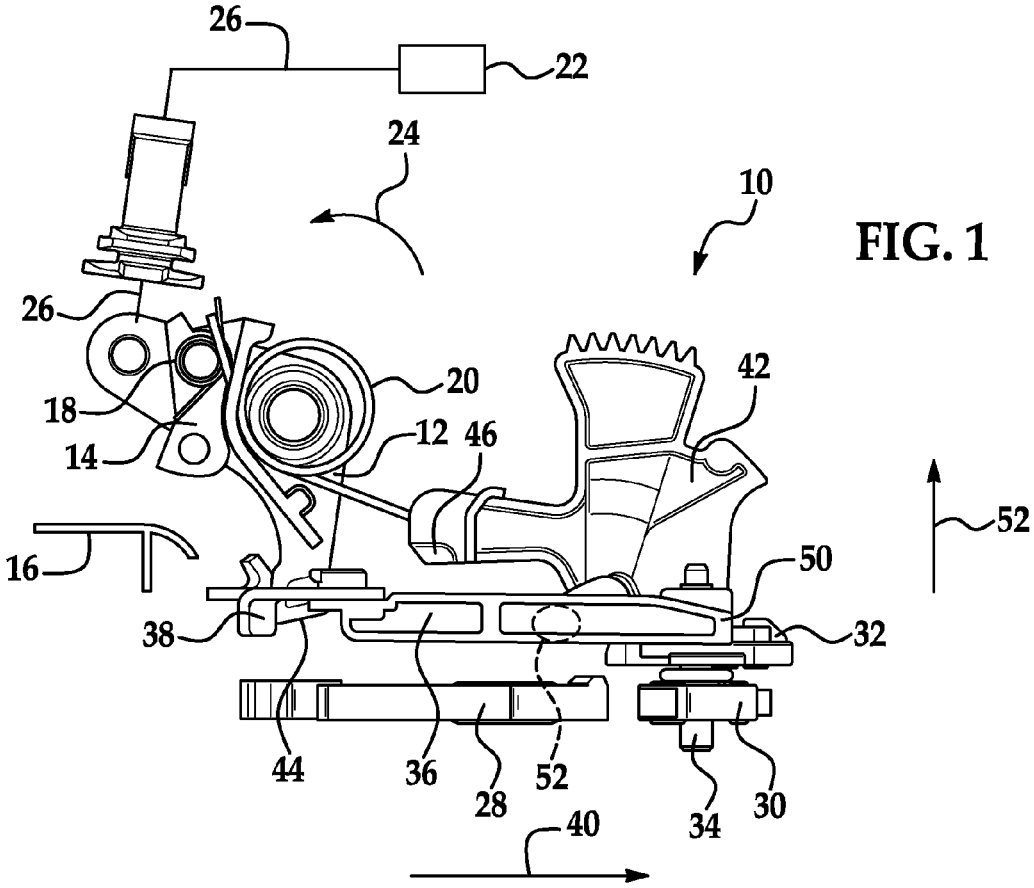
FIG. 1 is a view illustrating a latch assembly in accordance with an exemplary embodiment of the present invention in an unlatched position.
Figure 2:
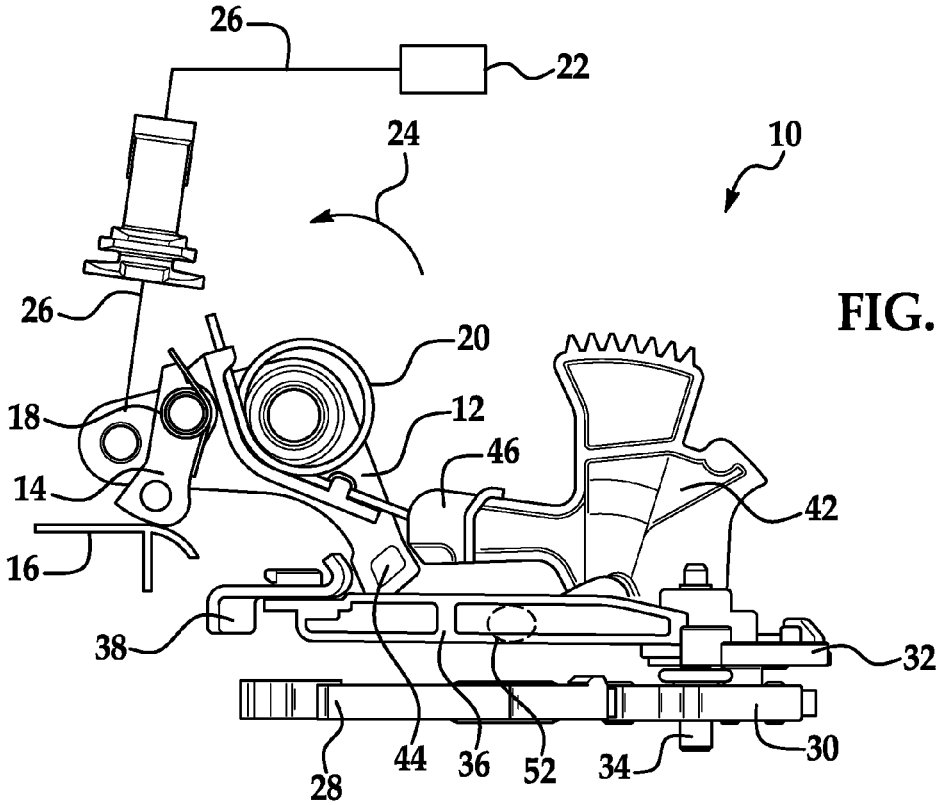
FIG. 2 is a view illustrating the latch assembly of FIG. 1 in a neutral position wherein the pendulum stop has engaged a surface portion of the latch assembly.
Figure 3:
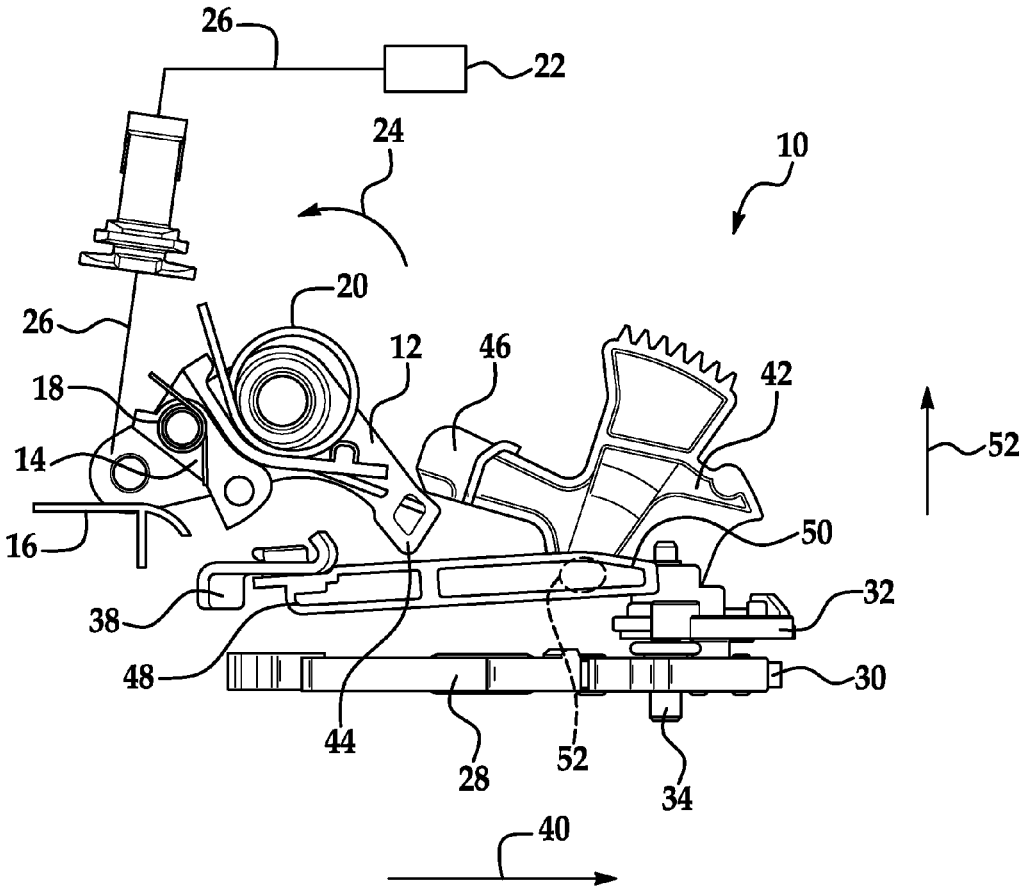
FIG. 3 is a view illustrating the latch assembly of FIG. 1 in a locked position.

Referring now to FIGS. 1-3, a latch assembly 10 in accordance with an exemplary embodiment of the present invention is illustrated. In FIG. 1 a release lever 12 of the latch assembly is illustrated in an unlatched position while FIG. 3 illustrates the release lever in a locked position. FIG. 2 illustrates the release lever in a neutral or home position between the locked and unlatched position and in this FIG. a pendulum stop 14 of the latch assembly has engaged a portion of a housing 16 of the latch assembly.

In an exemplary embodiment, the release lever 12 is pivotally secured to the latch assembly for movement between a latched position (FIG. 3) and an unlatched position (FIG. 1). The pendulum stop 14 is pivotally secured to the release lever for movement between a blocking position (FIG. 2) and an unblocking position (FIGS. 1 and 3), wherein the release lever is prevented from moving to the locked position when the pendulum stop is in the blocking position.

The movement of the pendulum stop is facilitated by the centripetal force acting upon the weighted pendulum and against a biasing force of a spring 18. The pendulum stop limits the movement of the release lever to a home or neutral position (FIG. 2) if the release lever is released from the maximum unlatch position illustrated in FIG. 1. After the pendulum stops the release lever at the home or neutral position, the spring 18 then retracts or moves the pendulum stop to the unblocking position and the release lever can be moved to the locked position. It is also noted that movement of the release lever from the locked position towards the unlatched position is not impeded by the pendulum stop.

As illustrated, spring 18 is provided to bias the pendulum stop into the unblocking position. However, the weight and pivotally securement of the pendulum stop to the release lever is configured such that movement of the release lever from the locked or home position towards the unlatched position by a cable pull subsequent release of the inner door handle pulling the cable will allow the release lever spring to rotate the release lever back towards the home position and wherein this movement will cause the pendulum stop to overcome the biasing force against it by spring 18 and move or rotate from the unblocking position to the blocking position. Thus, undesired movement of the release lever from the unlatched position to the locked position by the biasing force of a return spring 20 of the release lever is limited to a predetermined neutral or home position between the locked position and the unlatched position.

Accordingly, the pendulum stop prevents the release lever from inadvertently traveling from unlatched position to the locked position through the release of an inner door release lever 22 (illustrated schematically) when the release lever is at the unlatched position and the biasing force of spring 20 rotates the release lever in the direction of arrow 24.

The release lever is coupled to the inner door release lever via a cable 26 which is used to rotate the release lever into the unlatched position when the inner door release lever is actuated. As discussed above, a release lever spring 20 is configured to provide a biasing force in the direction of arrow 24 such that upon release of the inner door release lever the release lever rotates back to the neutral or home position illustrated in FIG. 2 while the pendulum stop prevents over travel of the release lever.

During further operation of the latch assembly, actuation of the inner door release lever in a direction opposite to the movement associated for unlatching will cause the cable to push the release lever into the locked position and movement of the inner door release handle and the cable in an opposite direction causes the cable to pull the release lever into the unlatched position.

Exemplary embodiments of the present invention relate to an apparatus and method for providing a latch assembly. Furthermore, exemplary embodiments are directed to a latch assembly having a fork bolt 28 movably secured thereto for movement between a latched position and an unlatched position. The latch assembly further comprises a detent lever 30 capable of movement between an engaged position and a disengaged position, wherein the detent lever retains the fork bolt in the latched position when the detent lever is in the engaged position. The latch assembly also includes a bell crank 32 for moving the detent lever from the engaged position to the disengaged position.

References made to the following United States patents: U.S. Pat. No. 3,969,789; and U.S. Pat. No. 6,568,741 and U.S. patent Publication No. 2002/0163207 the contents each of which are incorporated herein by reference thereto.

As is known in the related arts the latch assembly may further comprise a frame plate or support that is adapted for fastening the latch assembly to a vehicle proximate to a compartment closure and the fork bolt or fork bolt lever is pivotally or rotationally mounted to frame plate about a pivot pin or stud that is received within a pivot pin opening of the fork bolt. Accordingly, the fork bolt is capable of rotational or pivotal movement between an open or unlatched position and a closed or latched position.

The latch assembly is attached to a vehicle structure such that the fork bolt is moved between the open position and the closed position when a door, window, lift gate, etc. is opened and closed and the fork bolt engages a striker that is attached to the door, window, lift gate, etc. Alternatively, the latch assembly can be secured to the door, window, lift gate, etc. and the striker is secured to the vehicle body at an opening into which the door, window, lift gate, etc. is received. The cooperation of a fork bolt and striker is well known and need not be described in detail.

The detent lever pivots on the support or frame plate about a pivot pin 34 received within a pivot pin opening in the detent lever. The detent lever cooperates with the fork bolt in a well known manner to retain the fork bolt in the closed position or release the fork bolt for return to the open position. That is, detent lever 30 pivots between a closed or engaged detent position shown in FIGS. 2 and 3 and a release or disengaged detent position illustrated in FIG. 1. In accordance with an exemplary embodiment of the present invention, fork bolt 28 is spring biased to the open position by a biasing member (e.g., coil spring or other equivalent member) that has one end attached to fork bolt 28 and the other end attached to the housing or other equivalent location. Similarly, a biasing member or spring will also bias the detent lever in the direction of a face of fork bolt 28.

In accordance with exemplary embodiments of the present invention, the fork bolt has an engagement surface or contact surface that slides along and makes contact with a complimentary engagement surface or contact surface of the detent lever when the fork bolt pivots or moves from the open position to the closed position and once in the closed position a surface of the fork bolt engages a surface of the detent lever thus engaging the fork bolt and securing it into the closed position when the striker is secured in a receiving opening of the fork bolt. Once the latch is in the closed position the detent lever is spring biased into contact with the fork bolt such that the fork bolt cannot rotate into the open position unless the detent lever is moved back to the release or disengaged detent position.

In order to move the detent lever to the disengaged position, an intermediate lever 36 is coupled to the bell crank at one end and a linkage member 38 at another end. The linkage member is pivotally mounted to the latch assembly such that is can be rotated or pivoted by movement of the release lever. For example and as illustrated in FIG. 1 movement of the release lever to the unlatched position causes movement of linkage member 38 which in turn causes linear movement of the intermediate lever in the direction of arrow 40, causes the bell crank to rotate and move the detent lever to a disengaged position such that the fork bolt can rotate.

In order to couple and uncouple the intermediate lever to the bell crank and ultimately the detent lever, a locking lever 42 is pivotally mounted to the latch assembly for movement between a first position (FIGS. 1 and 2), wherein the intermediate lever is coupled to the detent lever, and a second position (FIG. 3) wherein the intermediate lever is uncoupled from the detent lever. Movement of the locking lever from the first position to the second position is achieved by movement of the release lever as it is moved to the locked position, wherein a distal end 44 of the release lever contacts a distal end 46 of the locking lever.

As illustrated, a first end 48 of the intermediate lever is movably mounted to the linking member 38 such that an opposite end 50 of the intermediate lever may move upwardly in the direction of arrow 52 such that end 50 and accordingly the intermediate lever 36 is uncoupled from the bell crank when end 50 the intermediate lever 36 is moved upward. In order to facilitate this movement a feature 52 of the locking lever 42 is received within a corresponding opening of the intermediate lever such that rotation or pivotal movement of the locking lever by the release lever moves the intermediate lever such that the same can be coupled and uncoupled from the bell crank and accordingly the detent lever.

When the intermediate lever is uncoupled from the detent lever, the movement of the intermediate lever by the linking member or any other component of the latch assembly will not cause the detent lever to become disengaged and thus the fork bolt will remain in a latched position.

Accordingly an apparatus and method for limiting movement of a release lever of a vehicle latch assembly is provided herein. Although not specifically illustrated and in addition to the fork bolt, the release lever and the detent lever being spring biased into a first or home position, the locking member and the linking member are also each biased into a first or home position such that movement rotational, pivotal or otherwise from the first or home position by an applied force the moved member will return to the first or home position by the biasing force of the appropriate biasing member once the applied force moving the member from the first or home position is removed.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A vehicle door latch assembly, comprising:

a release lever pivotally secured to the latch assembly for movement between a locked position and an unlatched position and a neutral position between the locked and unlatched position, wherein the release lever is spring biased into the neutral position;

a pendulum stop pivotally secured to the release lever for movement between a blocking position and an unblocking position, wherein the release lever is prevented from moving to the locked position from unlatched position when the pendulum stop is in the blocking position;

a spring for biasing the pendulum stop into the unblocking position wherein the pendulum stop is configured such that movement of the release lever from the unlatched position towards the neutral position will cause the pendulum stop to move from the unblocking position to the blocking position such that movement of the release lever from the unlatched position to the locked position is prevented without the release lever first stopping at the neutral position;

a locking lever pivotally mounted to the latch assembly for movement between a first position, wherein an intermediate lever of the latch assembly is coupled to a detent lever, and a second position wherein the intermediate lever is uncoupled from the detent lever by pivoting the intermediate lever from a coupling position to an uncoupling position, the locking lever being moved from the first position to the second position by the release lever as it is moved from the neutral position to the locked position, wherein the intermediate lever is only moved linearly when the release lever is moved between the neutral position and the unlatched position.

2. The vehicle door latch assembly as in claim 1, wherein the release lever is coupled to an inner door release lever via a cable, wherein movement of the inner door handle from a first position in a first direction moves the release lever from the neutral position to the unlatched position and wherein movement of the inner door handle from the first position in a second direction opposite to the first direction moves the release lever from the neutral position to the locked position.

3. The vehicle door latch assembly as in claim 2, wherein the cable pushes the release lever into the locked position as the door handle is moved in the second direction and wherein the cable pulls the release lever into the unlatched position as the door handle is moved in the first direction.

4. The vehicle door latch assembly as in claim 1, wherein the spring moves the pendulum from the blocking position to the unblocking position after the release lever has stopped at the neutral position.

5. The vehicle door latch assembly as in claim 1, further comprising a release lever spring for biasing the release lever towards the neutral position.

6. The vehicle door latch assembly as in claim 1, wherein the intermediate lever is pivotally mounted to a linkage member at one end and a feature of the locking lever at another end, wherein the linkage member is moved by the release lever as the release lever is moved between the unlatched position and the locked position.

7. The vehicle door latch assembly as in claim 6, wherein the intermediate lever moves the detent lever to a disengaged position such that a fork bolt may be moved to an open position when the intermediate lever is coupled to the detent lever and the release lever is moved to the unlatched position.

8. The vehicle door latch assembly as in claim 7, further comprising a bell crank coupled to the detent lever at one end and the intermediate lever at another end.

9. The vehicle door latch assembly as in claim 7, wherein the release lever is coupled to an inner door release lever via a cable, wherein movement of the inner door release lever from a first position in a first direction moves the release lever from the neutral position to the unlatched position and wherein movement of the inner door handle from the first position in a second direction opposite to the first direction moves the release lever from the neutral position to the locked position and wherein the cable pushes the release lever into the locked position and the cable pulls the release lever into the unlatched position as the cable moves in the first direction and the second direction.

10. The vehicle door latch assembly as in claim 9, wherein the spring moves the pendulum from the blocking position to the unblocking position after the release lever has stopped at the neutral position.

11. The vehicle door latch assembly as in claim 10, further comprising a release lever spring for biasing the release lever towards into the neutral position.

12. A method of limiting movement of a release lever of a vehicle latch assembly, the method comprising:

pivotally securing the release lever to the vehicle latch assembly for movement between an unlatched position and a locked position and a neutral position between the locked position and the unlatched position, wherein the release lever is spring biased into the neutral position;

pivotally securing a pendulum stop lever to the release lever for movement between a blocking position and an unblocking position, wherein the release lever is prevented from moving to the locked position when the pendulum stop is in the blocking position;

biasing the pendulum stop into the unblocking position wherein the pendulum stop is configured such that movement of the release lever from the unlatched position to the neutral position will cause the pendulum stop to move from the unblocking position to the blocking position such that movement of the release lever from the unlatched position to the locked position cannot occur without the release lever stopping at the neutral position first.

13. The method as in claim 12, wherein the release lever is coupled to an inner door release lever via a cable and wherein the spring moves the pendulum from the blocking position to the unblocking position after the release lever has stopped at the neutral position.

14. The method as in claim 12, further comprising: pivotally mounting a locking lever to the latch assembly for movement between a first position, wherein an intermediate lever is coupled to a detent lever, and a second position wherein the intermediate lever is uncoupled from the detent lever, the locking lever being moved from the first position to the second position by the release lever as it is moved to the locked position from the neutral position.

15. The method as in claim 14, wherein the intermediate lever is pivotally mounted to a linkage member at one end and a feature of the locking lever at another end, wherein the linkage member is moved by the release lever as the release lever is moved towards the unlatched position and wherein the intermediate lever is only linearly moved when the release lever is moved between the neutral position the unlatched position.

16. The method as in claim 15, wherein the intermediate lever moves the detent lever to a disengaged position such that a fork bolt may be moved to an open position when the intermediate lever is coupled to the detent lever and the release lever is moved to the unlatched position.

17. The method as in claim 16, further comprising a bell crank coupled to the detent lever at one end and the intermediate lever at another end.

18. The method as in claim 16, wherein the release lever is coupled to an inner door release lever via a cable and wherein the spring moves the pendulum from the blocking position to the unblocking position after the release lever has stopped at the neutral position.

* * * * *